US011600483B2

(12) United States Patent
O'Connor et al.

(10) Patent No.: US 11,600,483 B2
(45) Date of Patent: Mar. 7, 2023

(54) MASS SPECTROMETRY

(71) Applicant: THE UNIVERSITY OF WARWICK, Coventry (GB)

(72) Inventors: Peter O'Connor, Coventry (GB); Maria A. Van Agthoven, Coventry (GB)

(73) Assignee: The University Of Warwick, Coventry (GB)

( * ) Notice: Subject to any disclaimer, the term of this patent is extended or adjusted under 35 U.S.C. 154(b) by 0 days.

(21) Appl. No.: 16/332,570

(22) PCT Filed: Sep. 12, 2017

(86) PCT No.: PCT/GB2017/052678

§ 371 (c)(1),
(2) Date: Mar. 12, 2019

(87) PCT Pub. No.: WO2018/046968

PCT Pub. Date: Mar. 15, 2018

(65) Prior Publication Data

US 2020/0335321 A1 Oct. 22, 2020

(30) Foreign Application Priority Data

Sep. 12, 2016 (GB) ..... 1615469

(51) Int. Cl.
*H01J 49/42* (2006.01)
*H01J 49/00* (2006.01)
*H01J 49/38* (2006.01)

(52) U.S. Cl.
CPC ..... *H01J 49/4225* (2013.01); *H01J 49/0063* (2013.01); *H01J 49/38* (2013.01); *H01J 49/424* (2013.01)

(58) Field of Classification Search
CPC ..... H01J 49/0027; H01J 49/0031; H01J 49/0063; H01J 49/38; H01J 49/42; H01J 49/4225; H01J 49/4245; H01J 49/424
See application file for complete search history.

(56) References Cited

U.S. PATENT DOCUMENTS 4,472,631 A 9/1984 Enke et al.
4,761,545 A * 8/1988 Marshall ..... H01J 49/427 250/282

(Continued)

FOREIGN PATENT DOCUMENTS

EP 2533042 A1 12/2012
WO 2015/133259 A1 9/2015

OTHER PUBLICATIONS

Search Report for GB1615469.2 dated Feb. 2, 2017.

(Continued)

*Primary Examiner* — David E Smith
(74) *Attorney, Agent, or Firm* — Young Basile Hanlon & MacFarlane, P.C.

(57) ABSTRACT

A method of carrying out mass spectrometry, comprising: using an electrostatic or electrodynamic ion trap to contain a plurality of ions, each ion having a mass to charge ratio, the ions having a first plurality of mass to charge ratios, each ion following a path within the electrostatic or electrodynamic ion trap having a radius; and for each of a second plurality of the mass to charge ratios: modulating the radii of the ions in a mass to charge ratio-dependent fashion dependent upon the mass to charge ratio; fragmenting the ions thus modulated in a radius-dependent fashion; and determining a mass spectrum of the ions.

21 Claims, 7 Drawing Sheets

(56) References Cited

U.S. PATENT DOCUMENTS

| | | | | |
|---|---|---|---|---|
| 4,855,893 | A | 7/1989 | Kratz | |
| 5,013,912 | A | 5/1991 | Guan et al. | |
| 6,870,157 | B1 | 3/2005 | Zare | |
| 7,193,207 | B1 * | 3/2007 | Ding | H01J 49/4295 250/282 |
| 8,927,295 | B2 | 1/2015 | Hassell et al. | |
| 2003/0071206 | A1 | 4/2003 | Belov et al. | |
| 2003/0146392 | A1 | 8/2003 | Kimmel et al. | |
| 2003/0183760 | A1 | 10/2003 | Tsybin et al. | |
| 2003/0189171 | A1 * | 10/2003 | Londry | H01J 49/4225 250/282 |
| 2005/0067564 | A1 * | 3/2005 | Douglas | H01J 49/4215 250/281 |
| 2006/0151689 | A1 | 7/2006 | Bateman | |
| 2007/0057173 | A1 | 3/2007 | Kovtoun | |
| 2008/0173807 | A1 | 7/2008 | Yoon et al. | |
| 2011/0006200 | A1 * | 1/2011 | Loboda | H01J 49/0031 250/281 |
| 2011/0168883 | A1 * | 7/2011 | Furuhashi | H01J 49/0059 250/288 |

OTHER PUBLICATIONS

International Search Report for PCT/GB2017/052678 dated Jan. 22, 2018.

Shenheng G et al: "Stored waveform inverse Fourier transform (SWIFT) ion excitation in trapped-ion mass spectometry: theory and applications", International Journal of Mass Spectrometry and Ion Processes, Elsevier Scientific Publishing Co. Amsterdam, NL, vol. 157-15, No. DOUBLE, Dec. 20, 1996 (Dec. 20, 1996), pp. 5-37, XP004062762, ISSN: 0168-1176, DOI: 10.1016/50168-1176(96)04461-8 Sections 8.3, 8.4; p. 30-p. 35.

Colorado A et al: "Use of Infrared Multi Phon Photodissoci At Ion With Swift for Electrospay Nization and Laser Desorption Applications in a Quadrupole Ion Trap Mass Spectome T Er" , Analytical Chemistry, American Chemical Society, US, vol. 68, No. 22, Nov. 15, 1996 (Nov. 15, 1996), pp. 4033-4043, XP000634995, ISSN: 0003-2700, DOI: 10. 102 1/AC9600565 Section IRMPD and SWIFT; p. 4039-p. 042.

Gabryelski Wojciech et al: "Photo-induced 1-28 dissociation of electrospray generated ions in an ion trap/time-of-flight mass sDprtmmptpr" Review of Scientific Instruments, AIP, Melville, NY, US, vol. 70, No. 11, Nov. 1, 1999 (Nov. 1, 1999), pp. 4192-4199, XP012037163, ISSN: 0034-6748, DOI: 10.1063/1.1150051 Section II. Experiments; p. 4193-p. 4195.

Kruger N A et al: "Electron capture dissociation of multiply charged peptidecations", International Journal of Mass Spectrometry, Elsevier Science Publishers, Amsterdam, NL, vol. 185-187, Apr. 29, 1999 (Apr. 29, 1999), pp. 787-793, XP027401133, ISSN: 1387-3806 [retrieved on Apr. 29, 1999] p. 788.

Hofstadler S A et al: "Infrared Multiphoton Dissociation in an Externalion Reservoir", Analytical Chemistry, American Chemical Society, US, vol. 71, No. 11, Jun. 1, 1999 (Jun. 1, 1999), pp. 2067-2070, P000835016, ISSN: 0003-2700, DOI: 10. 1021/AC990176N p. 2068-p. 2069; figure 1.

* cited by examiner

MASS SPECTROMETRY

CROSS-REFERENCE TO RELATED APPLICATION(S)

This application is a 371 application of International Application No. PCT/GB2017/052678, filed on Sep. 12, 2017, which claims priority to Great Britain Patent Application No. 1615469.2, filed on Sep. 12, 2016, the disclosures of both of which are hereby incorporated by reference in their entireties.

TECHNICAL FIELD

This disclosure relates to a method of carrying out mass spectrometry and to a mass spectrometry instrument.

BACKGROUND

Two-dimensional mass spectrometry (2D MS) is a technique that correlates precursor and fragment ions in a sample without requiring prior ion isolation. 2D MS was first proposed by Pfändler et al. in 1987 (P. Pfaendler, G. Bodenhausen, J. Rapin, R. Houriet, T. Gaumann. Two-dimensional Fourier transform ion cyclotron resonance mass spectrometry. Chem. Phys. Lett. 1987, 138, 195; P. Pfaendler, G. Bodenhausen, J. Rapin, M. E. Walser, T. Gaumann. Broadband two-dimensional Fourier transform ion cyclotron resonance. J. Am. Chem. Soc. 1988, 110, 5625; M. Bensimon, G. Zhao, T. Gaumann. A method to generate phase continuity in two-dimensional Fourier transform ion cyclotron resonance mass spectrometry. Chem. Phys. Lett. 1989, 157, 97) on a Fourier transform ion cyclotron resonance mass spectrometer (FT-ICR MS) (M. B. Comisarow, A. G. Marshall. Fourier transform ion cyclotron resonance spectroscopy. Chem. Phys. Lett. 1974, 25, 282). The pulse sequence for 2D MS was inspired both by NOESY NMR spectroscopy (A. Kumar, R. R. Ernst, K. Wuethrich. A two-dimensional nuclear Overhauser enhancement (2D NOE) experiment for the elucidation of complete proton-proton cross-relaxation networks in biological macromolecules. *Biochem. Biophys. Res. Commun.* 1980, 95, 1) and by phase-reversion experiments performed Marshall et al. (A. G. Marshall, T. C. L. Wang, T. L. Ricca. Ion cyclotron resonance excitation/deexcitation: a basis for stochastic Fourier transform ion cyclotron mass spectrometry. *Chem. Phys. Lett.* 1984, 105, 233). Using two identical excitation pulses separated by a regularly incremented delay, ion cyclotron radii were modulated according to their cyclotron frequency (i.e. mass-to-charge ratio) before a fragmentation period with a radius-dependent fragmentation method (S. Guan, P. R. Jones. A theory for two-dimensional Fourier-transform ion cyclotron resonance mass spectrometry. *J. Chem. Phys.* 1989, 91, 5291). The resulting 2D mass spectrum shows the fragmentation patterns of all ions from the sample, which enables to easily extract fragment ion scans, precursor ion scans and neutral loss lines, as well as electron capture lines in some cases (M. A. van Agthoven, M.-A. Delsuc, G. Bodenhausen, C. Rolando. Towards analytically useful two-dimensional Fourier transform ion cyclotron resonance mass spectrometry. *Anal. Bioanal. Chem.* 2013, 405, 51). Since 2D mass spectra show the fragmentation patterns of all ions from a sample without requiring ion isolation, this technique can be said to be truly comprehensive and can be of great use for the analysis of complex samples.

Since 2010, thanks to improvements in computational capacities for data processing and storage, 2D MS on FT-ICR instruments has been developed into a fully-fledged analytical technique with infrared multiphoton dissociation (IRMPD) and electron capture dissociation (ECD) as fragmentation methods (M. A. van Agthoven, M.-A. Delsuc, C. Rolando. Two-dimensional FT-ICR/MS with IRMPD as fragmentation mode. *Int. J. Mass Spectrom.* 2011, 306, 196; M. A. van Agthoven, L. Chiron, M.-A. Coutouly, M.-A. Delsuc, C. Rolando. Two-Dimensional ECD FT-ICR Mass Spectrometry of Peptides and Glycopeptides. *Anal. Chem.* 2012, 84, 5589; M. A. van Agthoven, L. Chiron, M.-A. Coutouly, A. A. Sehgal, P. Pelupessy, M.-A. Delsuc, C. Rolando. Optimization of the discrete pulse sequence for two-dimensional FT-ICR mass spectrometry using infrared multiphoton dissociation. *Int. J. of Mass Spectrom.* 2014, 370, 114). De-noising algorithms have been developed in order to reduce the effects of noise in 2D mass spectra (M. A. van Agthoven, M.-A. Coutouly, C. Rolando, M.-A. Delsuc. Two-dimensional Fourier transform ion cyclotron resonance mass spectrometry: reduction of scintillation noise using Cadzow data processing. *Rapid Commun. Mass Spectrom.* 2011, 25, 1609; L. Chiron, M. A. van Agthoven, B. Kieffer, C. Rolando, M.-A. Delsuc. Efficient denoising algorithms for large experimental datasets and their applications in Fourier transform ion cyclotron resonance mass spectrometry. *Proc. Natl. Acad. Sci. U.S.A* 2014, 111, 1385.). 2D MS has been successfully applied to the analysis of small molecules (M. van Agthoven, M. Barrow, L. Chiron, M.-A. Coutouly, D. Kilgour, C. Wootton, J. Wei, A. Soulby, M.-A. Delsuc, C. Rolando, P. O'Connor. Differentiating Fragmentation Pathways of Cholesterol by Two-Dimensional Fourier Transform Ion Cyclotron Resonance Mass Spectrometry. *J. Am. Soc. Mass Spectrom.* 2015, 26, 2105) as well as in bottom-up (H. J. Simon, M. A. van Agthoven, P. Y. Lam, F. Floris, L. Chiron, M. A. Delsuc, C. Rolando, M. P. Barrow, P. B. O'Connor. Uncoiling collagen: a multidimensional mass spectrometry study. *Analyst* 2016, 141, 157; M. A. van Agthoven, C. A. Wootton, L. Chiron, M.-A. Coutouly, A. Soulby, J. Wei, M. P. Barrow, M.-A. Delsuc, C. Rolando, P. B. O'Connor. Two-Dimensional Mass Spectrometry for Proteomics, a Comparative Study with Cytochrome c. *Anal. Chem.* (Washington, D.C., U. S.) 2016, 88, 4409) and top-down (F. Floris, M. van Agthoven, L. Chiron, A. J. Soulby, C. A. Wootton, Y. P. Y. Lam, M. P. Barrow, M.-A. Delsuc, P. B. O'Connor. 2D FT-ICR MS of Calmodulin: A Top-Down and Bottom-Up Approach. *Journal of The American Society for Mass Spectrometry* 2016, 27, 1531) proteomics.

In 1993, Ross et al. proposed an alternative pulse sequence of 2D MS on an FT-ICR mass spectrometer (C. W. Ross, III, S. Guan, P. B. Grosshans, T. L. Ricca, A. G. Marshall. Two-dimensional Fourier transform ion cyclotron resonance mass spectrometry/mass spectrometry with stored-waveform ion radius modulation. *J. Am. Chem. Soc.* 1993, 115, 7854). Instead of using delays between pulses, this pulse sequence uses the fact that the cyclotron radius of an ion after excitation is proportional to the product of the excitation amplitude and the excitation length (M. V. Gorshkov, E. N. Nikolaev. Optimal cyclotron radius for high resolution FT-ICR spectrometry. *Int. J. Mass Spectrom. Ion Processes* 1993, 125, 1). Using stored waveform inverse Fourier transform techniques (SWIFT) (A. G. Marshall, T. C. L. Wang, L. Chen, T. L. Ricca. New excitation and detection techniques in Fourier transform ion cyclotron resonance mass spectrometry. *ACS Symp. Ser.* 1987, 359, 21), excitation pulses were generated with amplitudes that were modulated according to the excitation frequency. Applying these excitation pulses to precursor ions in the ICR cell modulated their cyclotron radii according to their cyclotron frequencies and therefore modulated the abundances of their fragments after radius-dependent fragmentation. This technique, called stored waveform ion radius modulation (SWIM), was applied to the analysis of amino acid dimers and trimers (G. van der Rest, A. G. Marshall. Noise analysis for 2D tandem Fourier transform ion cyclotron resonance mass spectrometry. *Int. J. Mass Spectrom.* 2001, 210/211, 101) and to the analysis of polymers and pharmaceutical products (C. W. Ross, W. J. Simonsick, Jr., D. J. Aaserud. Application of Stored Waveform Ion Modulation 2D-FTICR MS/MS to the Analysis of Complex Mixtures. *Anal. Chem.* 2002, 74, 4625). However, due to fact that SWIFT is not available on most commercial FT-ICR instruments, the original pulse sequence for 2D FT-ICR MS is easier to use than SWIM.

Although 2D MS shows good results on FT-ICR instruments, its development is hampered by the fact that FT-ICR instruments are expensive to purchase and maintain. Furthermore, due to the duty cycle of the FT-ICR mass spectrometer, each 2D MS experiment can take 30 minutes or more. Developing 2D mass spectrometry techniques that can be applied to other mass spectrometers is therefore important for the development of data-independent structural analysis of complex samples.

Linear ion traps (LIT) (J. C. Schwartz, M. W. Senko, J. E. P. Syka. A two-dimensional quadrupole ion trap mass spectrometer. *J. Am. Soc. Mass Spectrom.* 2002, 13, 659) are popular ion manipulation devices. Their dimensions allow for larger ion populations than quadrupolar ion traps (R. E. March. An introduction to quadrupole ion trap mass spectrometry. *Journal of Mass Spectrometry* 1997, 32, 351). Resonant mass-selective radial excitation is well-established with LITs (B. A. Collings, W. R. Stott, F. A. Londry. Resonant excitation in a low-pressure linear ion trap. *Journal of the American Society for Mass Spectrometry* 2003, 14, 622; D. J. Douglas, N. V. Konenkov. Mass selectivity of dipolar resonant excitation in a linear quadrupole ion trap. *Rapid Communications in Mass Spectrometry* 2014, 28, 430).

SUMMARY

According to a first aspect of the disclosure, there is provided a method of carrying out mass spectrometry, comprising:

- using an electrostatic or electrodynamic ion trap to contain a plurality of ions, each ion having a mass to charge ratio, the ions having a first plurality of mass to charge ratios, each ion following a path within the electrostatic or electrodynamic ion trap having a radius; and
- for each of a second plurality of the mass to charge ratios:
  - modulating the radii of the ions in a mass to charge ratio-dependent fashion dependent upon the mass to charge ratio;
  - fragmenting the ions thus modulated in a radius-dependent fashion; and
  - determining a mass spectrum of the ions.

Thus, we have provided for the application of two dimensional (2D) mass spectrometry (MS) in an electrostatic or electrodynamic ion trap; the collation of the mass spectra from all of the scans will provide information about the mass to charge ratio of the fragments (one dimension) correlated with the mass to charge ratio of the precursors (due to the mass to charge ratio dependency on the radius modulation controlling which ions are fragmented). The inventors have appreciated that, amongst other things, performing 2D MS in an electrostatic or electrodynamic ion trap can be quicker than carrying it out as previously has been done in a Fourier Transform Ion Cyclotron Resonance mass spectrometer (FT ICR MS). Indeed, if the mass spectra can be taken quickly enough, analysis may be possible on liquid chromatography (LC) or gas chromatography (GC) timescales. Furthermore, an electrostatic or electrodynamic ion trap requires less stringent vacuum conditions than a FT ICR MS, and so is more tolerant to the presence of atmospheric (or other non-analyte) gasses.

Typically, the electrostatic or electrodynamic ion trap will comprise a linear ion trap (LIT). Alternatively, the electrostatic or electrodynamic ion trap may comprise a quadrupolar ion trap, a three-dimensional ion trap or an ion trap whose ions have consistent oscillation frequencies.

The modulation of the radii may comprise modulating an electric field applied to the ions. In one implementation, excitation pulses can be applied separated by a delay, with the delay providing the mass to charge ratio dependence. However, in a preferred implementation, a modulated excitation pulse can be provided, which is modulated at a frequency. This will typically be such so as to provide a resonance with an oscillation frequency of ions having the mass to charge ratio. As such, the modulated excitation pulse may comprise a Stored Waveform Inverse Fourier Transform (SWIFT) or Stored Waveform Ion Radius Modulation (SWIM) pulse. This latter implementation does not require the ions as a whole to be coherent. Indeed, an advantage of SWIM is that, unlike the original 2D FT-ICR pulse sequence, the radial modulation does not require the ion cloud to be coherent. If the overlap between the density of an ion species and the fragmentation zone can be modulated using SWIM, then fragment ion abundances can be modulated according to the resonant frequencies of their precursors, which then makes 2D mass spectrometry in an electrostatic or electrodynamic ion trap easier.

As such, the step of fragmenting the ions may comprise fragmenting ions which pass through a fragmentation zone. The modulation of the radii may modulate radii of ions into and/or out of the fragmentation zone. Typically, the fragmentation zone will be at lower radius, typically comprising zero radius.

The step of fragmenting the ions may comprise laser-based (comprising application of a laser beam to the ions, typically in the fragmentation zone), electron-based (comprising application of a beam of electrons to the ions, typically in the fragmentation zone) or collision-based (comprising colliding the ions with gas molecules, typically in the fragmentation zone) fragmentation methods.

The mass spectra can be determined through any convenient means. In one implementation, the mass spectra can be determined using a time of flight (TOF) mass spectrometer. This is quick, although less accurate and well-resolved than some other MS devices. The application of a TOF MS to the method of this disclosure has been found to be particularly advantageous as the speed of operation of the method of this disclosure and the TOF MS work synergistically together. However, other mass spectrometry methods can be used, such as Fourier Transform Ion Cyclotron Resonance (FT ICR), a Linear Ion Trap (LIT), an Orbitrap mass spectrometer, a triple quadrupole (QQQ) mass spectrometer or other such methods.

The second plurality of mass to charge ratios may be the same as the first plurality of mass to charge ratios, or may be a subset or superset thereof. Typically, the second plurality of mass to charge ratios will comprise a range of mass to charge ratios, typically discretely spaced through a continuous range.

According to a second aspect of the disclosure, there is provided a mass spectrometry instrument, comprising an electrostatic or electrodynamic ion trap and a control circuit for the electrostatic or electrodynamic ion trap, the electrostatic or electrodynamic ion trap comprising electrodes comprising at least two axial trapping electrodes, a plurality of radial trapping electrodes and at least one excitation electrode, in which the control circuit is arranged so as to:

apply voltage to each excitation electrode so as to contain, in use, a plurality of ions within a void defined by the electrodes, each ion following a path within the electrostatic or electrodynamic ion trap having a radius; and modulating the radii of the ions dependent upon the mass to charge ratio of the ions;

the instrument further comprising a fragmentation device arranged to fragment the ions thus modulated in a radius-dependent fashion; and a mass determination device arranged to determine a mass spectrum of the ions.

Thus, we have provided for the application of two dimensional (2D) mass spectrometry (MS) in an electrostatic or electrodynamic ion trap; the collation of the mass spectra from a series of the scans where the mass to charge ratio-dependent modulation selectively modulates ions of differing mass to charge ratios will provide information about the mass to charge ratio of the fragments (one dimension) correlated with the mass to charge ratio of the precursors (due to the mass to charge ratio dependency on the radius modulation controlling which ions are fragmented). The inventors have appreciated that, amongst other things, performing 2D MS in an electrostatic or electrodynamic ion trap can be quicker than carrying it out as previously has been done in a Fourier Transform Ion Cyclotron Resonance mass spectrometer (FT ICR MS). Indeed, if the mass spectra can be taken quickly enough, analysis may be possible on liquid chromatography (LC) or gas chromatography (GC) timescales. Furthermore, an electrostatic or electrodynamic ion trap requires less vacuum than a FT ICR MS, and so is more tolerant to the presence of atmospheric (or other non-analyte) gasses.

Typically, the electrostatic or electrodynamic ion trap will comprise a linear ion trap (LIT). Alternatively, the electrostatic or electrodynamic ion trap may comprise a quadrupolar ion trap, a three-dimensional ion trap or an ion trap whose ions have consistent oscillation frequencies.

The modulation of the radii may comprise modulating an electric field applied to the ions using each excitation electrode. In one implementation, the control circuit is arranged to apply excitation pulses to each excitation electrode, separated by a delay, with the delay providing the mass to charge ratio dependence. However, in a preferred implementation, the control circuit will be arranged to apply a modulated excitation pulse to each excitation electrode, which is modulated at a frequency. This will typically be such so as to provide a resonance with an oscillation frequency of ions having a particular mass to charge ratio. As such, the modulated excitation pulse may comprise a Stored Waveform Ion Radius Modulation (SWIM) pulse. This latter implementation does not require the ions as a whole to be coherent.

The control circuit may be arranged such that the modulation of the radii comprises preferentially changing the radii of ions having the particular mass to charge ratio to a path with a different radius, or preferentially changing the radii of ions not having the particular mass to charge ratio to a path with a different radius. As such, the fragmentation device may preferentially fragment ions that do, or do not, have the particular mass to charge ratio.

As such, the fragmentation device may be arranged to fragment ions which pass through a fragmentation zone. The control circuit may be arranged to as to modulate the radii so as to shift ions into and/or out of the fragmentation zone. Typically, the fragmentation zone will be at lower radius, typically comprising zero radius.

The fragmentation device may comprise a laser (arranged to apply a laser beam to the ions, typically in the fragmentation zone), an electron source (arranged to apply a beam of electrons to the ions, typically in the fragmentation zone) or a collision source (arranged to collide gas molecules with the ions, typically in the fragmentation zone).

The mass determination device can be any convenient means. In one implementation, it can comprise a time of flight (TOF) mass spectrometer, to which ions are transferred after fragmentation. This is quick, although less accurate than some other MS devices. The application of a TOF MS to the method of this disclosure has been found to be particularly advantageous as the speed of operation of the method of this disclosure and the TOF MS work synergistically together. However, other mass determination devices can be used, such as a Fourier Transform Ion Cyclotron Resonance (FT ICR) mass spectrometer, a Linear Ion Trap (LIT) mass spectrometer, an Orbitrap mass spectrometer, a triple quadrupole (QQQ) mass spectrometer or other mass spectrometers.

BRIEF DESCRIPTION OF DRAWINGS

There now follows by way of example only, description of implementations of the disclosure, described with reference to the accompanying drawings, in which.

DETAILED DESCRIPTION

In a first implementation of the disclosure, we describe a mass spectrometry instrument which demonstrates the feasibility of 2D mass spectrometry in a linear ion trap (LIT), explored using SIMION ion trajectory calculations.

All simulations were performed using SIMION 8.0 (Scientific Instrument Services, Ringoes, N.J., USA) on an ion optic bench with the following dimensions: x=16 mm, y=16 mm, z=83 mm. The linear ion trap (LIT) was built in a single potential array with a mirror symmetry around the y=0 plane and is similar to the one modelled by Schwartz et al. (J. C. Schwartz, M. W. Senko, J. E. P. Syka. A two-dimensional quadrupole ion trap mass spectrometer. *J. Am. Soc. Mass Spectrom.* 2002, 13, 659). The potential array contained 11 electrodes with a 10 grid unit/mm precision and was refined with a convergence limit of $10^{-5}$.

Figure 1:
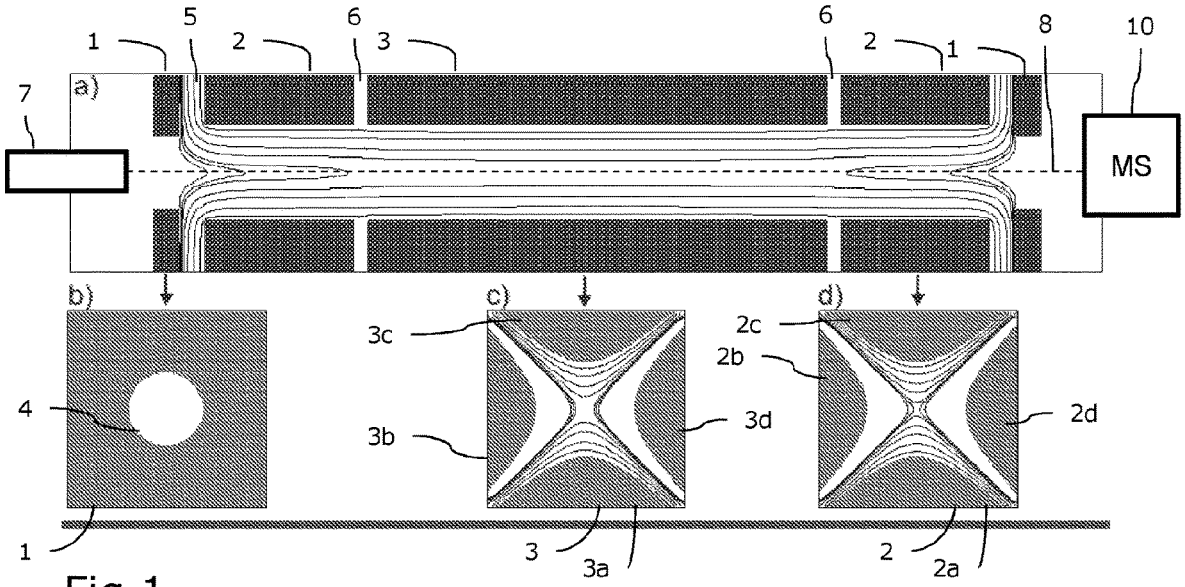
FIGS. 1*a* to 1*d* show cross sections through a mass spectrometry instrument in accordance with a first implementation of the disclosure.

FIG. 1 shows the ion optics bench containing the La. FIG. 1*a* shows that two end-caps 1 are used to contain ions axially and three quadrupoles 2, 3 (two matching outer quadropoles 2 and an centre quadrupole 3) are used to contain ions radially. FIG. 1*b* shows the end-cap electrodes 1: their thickness is 2 mm and their opening has a 3 mm radius. They are separated from the outer quadrupoles 2 by a 2 mm gap 5. FIGS. 1*c* and 1*d* show that the quadrupole rods 2*a*-2*d*, 3*a*-3*d* forming the quadrupoles 2, 3 are hyperbolically shaped with an internal radius of 4 mm, about an axis 8. The length of the outer quadrupoles 2 is 12 mm. The length of the centre quadrupole 3 is 37 mm. The quadrupoles 2, 3 are each separated by a 1 mm gap 6. An on-axis laser 7 provides for radius-dependent fragmentation of ions held in the trap. The voltages applied on the quadrupoles in this instance are +10.0 $V_{DC}$ on the end caps 1, +5.0 $V_{DC}$ on the outer quadrupole rods 2*a*-2*d*, +/−100.0 $V_{RF}$ on the centre quadrupole rods 3*a*-3*d*. The equipotential lines are for: −100.0 V, −75.0 V, −50.0 V, −25.0 V, −10.0 V, 0.0 V, +2.5 V, 5.0 V, and 10.0 V.

Whilst not directly simulated here, the contents of the LIT can be transferred to a further mass spectrometer 10 to determine the mass spectrum after each excitation and fragmentation as explained below.

Figure 2:
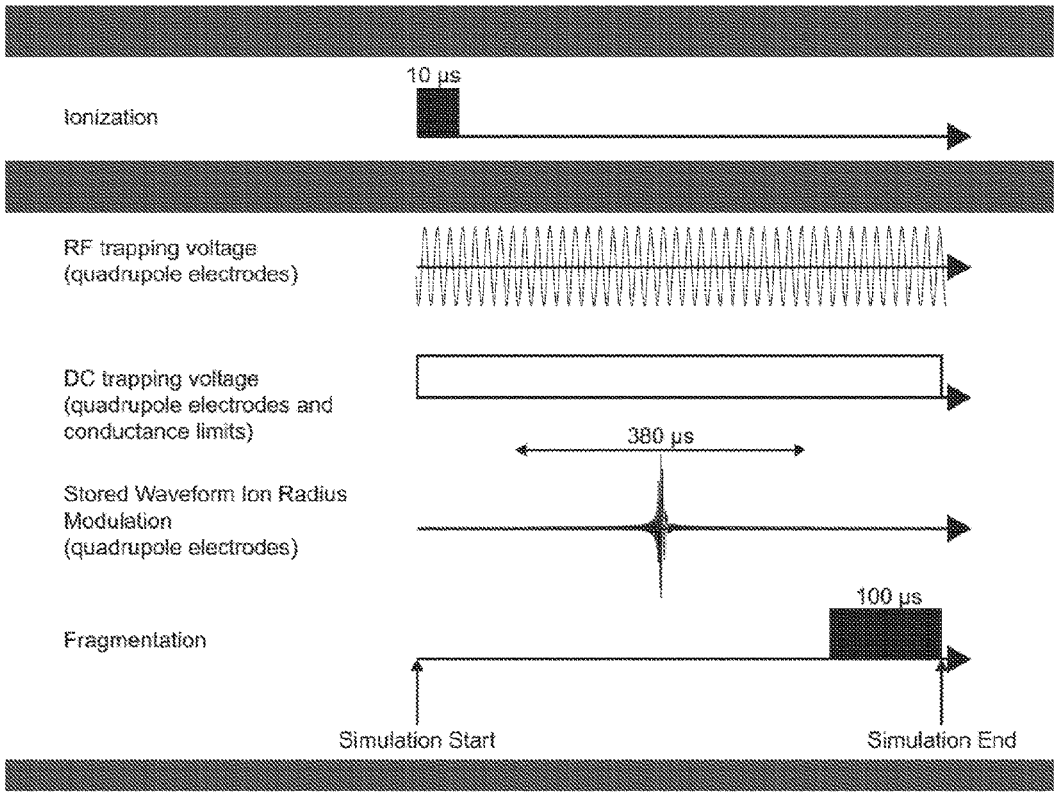
FIG. 2 shows the relative timing of various signals applied to the instrument of FIG. 1.

FIG. 2 shows the experimental timings used to simulate ion trajectories. The workbench program used in order to generate the experimental conditions was written in Lua 5.1.1 (Rio de Janeiro, RJ, Brazil) programming. Ionisation was randomized in an area with a 0.2 mm radius in the middle of the LIT during the first 10 μs of each ion trajectory simulation (initialize segment). Continuous trapping voltages were set at +10.0 V on the end-cap electrodes and +5.0 V on the rods of the outer quadrupoles throughout the ion trajectory simulation. A radiofrequency voltage with a 300.0 $V_{pp}$ amplitude and a 1.1 MHz frequency was applied to all three quadrupoles.

After 50.0 μs, an excitation pulse generated externally using SWIFT was applied to the rods 3*a*-3*d* of the centre quadrupole 3 with a 700.00 $V_{0p}$, amplitude and a 20-550 kHz frequency range as explained below. The length of each pulse was set at 380 μs.

At the end of the excitation pulse, a fragmentation period modelled on the use of laser 7, using a top-hat fragmentation zone with a 0.05 mm radius about axis 8. The probability of fragmentation was calculated using the following equation:

$$P=1-e^{-t/T_{decay}} \quad \text{(eq. 1)}$$

in which P is the probability of fragmentation, t the time that the ion has spent within the fragmentation zone during the fragmentation period and $T_{decay}$, was set at 500.0 μs. This model was chosen in order to mimic a laser-based fragmentation method. Both the radius of the fragmentation zone and the time decay were chosen arbitrarily in order to result in reasonable fragmentation efficiency. Only one fragmentation was allowed during each ion trajectory simulation. After the fragmentation period the ion trajectory calculation was set to end. The experimental script was repeated 128 times with 128 different excitation pulses.

SWIM Pulse Generation

Figure 3:
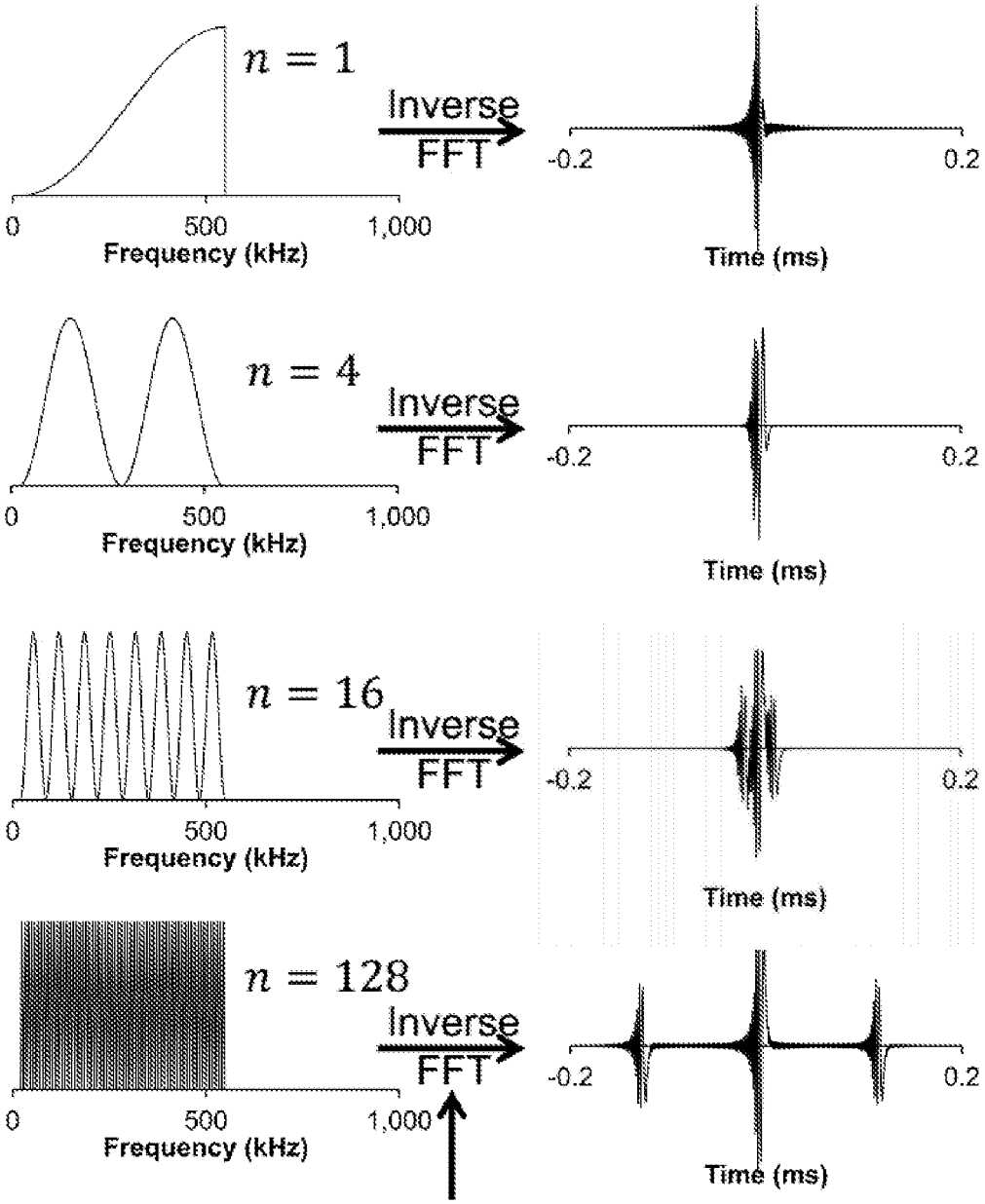
FIG. 3 shows excitation signals applied to the electrodes of the instrument of FIG. 1.

128 Stored Waveform Ion Radius Modulation (SWIM) pulses were generated using python 2.7 programming language in the Spyder 2.3.8 development environment (Anaconda, Continuum Analytics, Austin, Tex., USA) and stored in a Comma Separated Values (csv) file format in order to be called by the SIMION workbench program. FIG. 3 summarizes the process of generating each pulse, as proposed by Ross et al. (C. W. Ross, III, S. Guan, P. B. Grosshans, T. L. Ricca, A. G. Marshall. Two-dimensional Fourier transform ion cyclotron resonance mass spectrometry/mass spectrometry with stored-waveform ion radius modulation. *J. Am. Chem. Soc.* 1993, 115, 7854; C. W. Ross, W. J. Simonsick, Jr., D. J. Aaserud. Application of Stored Waveform Ion Modulation 2D-FTICR MS/MS to the Analysis of Complex Mixtures. *Anal. Chem.* 2002, 74, 4625). The frequency range of each pulse is 20-2117.151 kHz, but the amplitude of each pulse is non-zero over a 20-550 kHz frequency range. The frequency increment was 1 Hz. The amplitude envelope of each pulse is determined by the following equation:

$$M_{(f,n)}=\frac{1}{2}\left(1+\sin\left(n\pi\left(\frac{f-f_{min}}{f_{max}-f_{min}}\right)-\frac{1}{2}\right)\right) \quad \text{(eq. 2)}$$

in which M is the amplitude, f the frequency, n the index of the pulse, $f_{max}$ the maximum frequency of the pulse (here, 550 kHz) and $f_{min}$ the minimum frequency of the pulse (here, 20 kHz).

In order to reduce the maximum voltage of the time-domain pulse, a quadratic phase function as proposed by Guan et al. (S. Guan, R. T. McIver, Jr. Optimal phase modulation in stored wave form inverse Fourier transform excitation for Fourier transform mass spectrometry. I. Basic algorithm. *J. Chem. Phys.* 1990, 92, 5841) was applied to the frequency-domain pulse:

$$\varphi_{(f)}=\frac{\pi}{20}\frac{(f-f_{min})^2}{f_{max,range}-f_{min}} \quad \text{(eq. 3)}$$

in which φ is the phase, f the frequency, $f_{max,range}$ the maximum frequency of the total frequency range (here, 2117.151 kHz) and $f_{min}$ the minimum frequency (here, 20 kHz). The resulting function, combining eq. 2 and eq. 3:

$$PM_{(f,n)}=M_{(f,n)}\times e^{i\varphi(f)} \quad \text{(eq. 4)}$$

was transformed into a time-domain pulse using the real part of its inverse fast Fourier transform.

The resulting time-domain pulse was 1 s long with a 0.477 μs time increment. The significant part of the pulse was truncated to 380 μs and interpolated in order to achieve a 10 ns time increment before storage in a csv file.

Particle Definition, Data Recording, and Data Processing

Ion trajectory calculations were run without Coulombic repulsion. For each SWIM pulse, the trajectory of 100 ions of m/z 166, m/z 195, and m/z 322 were calculated. The m/z ratios of their fragments were m/z 122, m/z 181, and m/z 190 respectively. All m/z ratios were chosen arbitrarily. For each ion trajectory calculation, the index, m/z ratio and time-of-flight of the ion were recorded and stored in a text file at the moment of ion splat or the end of the simulation. The total ion current (TIC) was defined as the number of ions still present in the LIT at the end of the simulation.

For the purposes of simulation, using python 2.7 programming language, the data recorded from the ion trajectory calculations was converted into a 2D mass spectrum, although in real world implementations a mass spectrometer (MS), typically a time of flight (TOF) MS would be used.

For each m/z ratio, the Fourier transform of the ion count was calculated along the SWIM index n in magnitude mode. Since the sampling rate of n is 1, this results in a Nyquist frequency for the encoding frequency of 0.5. The frequency increment is 1/64, since the ion count was measured over 128 data points. A quadratic fit was used for frequency-to-mass conversion using the three precursor ion m/z ratios and encoding frequencies as reference points (E. B. Ledford, Jr., D. L. Rempel, M. L. Gross. Space charge effects in Fourier transform mass spectrometry. II. Mass calibration. *Anal. Chem.* 1984, 56, 2744).

Simulation Results

Frequencies of ion trajectories in a quadrupole are determined by the following equation:

$$f_r = \beta_r \times \frac{f_{drive}}{2} \quad \text{(eq. 5)}$$

In which $f_r$ is the radial frequency, $f_{drive}$ the frequency of the RF voltage applied to the quadrupole electrodes, and $\beta_r$ the stability parameter used to solve the Mathieu equation in the radial dimension ($0 \leq \beta_r \leq 1$). In the area of the stability diagram generally used in mass spectrometry, the $\beta_r$ stability parameter decreases when the m/z ratio increases (R. E. March. An introduction to quadrupole ion trap mass spectrometry. *Journal of Mass Spectrometry* 1997, 32, 351). Resonant RF voltages can be used in order to radially excite or destabilize ions of given m/z ratios in a quadrupole. Radial excitation increases with the RF amplitude and the length of the excitation voltage.

This effect has been used for ion isolation in linear ion traps by Hilger et al. (R. T. Hilger, R. E. Santini, C. A. Luongo, B. M. Prentice, S. A. McLuckey. A method for isolating ions in quadrupole ion traps using an excitation waveform generated by frequency modulation and the quadrupole rods. However, many different electrodes shapes have been developed and tested for linear ion traps with similar results in terms of resonant frequencies. As long as resonant frequencies are stable over the size of the fragmentation zone, the quality of the radial modulation is unlikely to be affected.

In each SWIM file, ions are radially excitation over a range of frequencies (i.e. m/z ratios) with frequency-dependent RF amplitudes given by eq. 2 on the basis of the frequencies defined in eq. 5. For a given m/z ratio, the amplitude at their resonant frequency (i.e. the radius of the ion cloud after excitation) is modulated according to the index of the SWIM file n with the following encoding frequency:

$$f_e = \frac{f_r - f_{min}}{2(f_{max} - f_{min})} \quad \text{(eq. 6)}$$

In which $f_e$ is the encoding frequency, $f_r$ is the resonant radial frequency of the ions' trajectory, $f_{min}$ is the minimum frequency of the frequency range (corresponding to the highest m/z ratio in the m/z range), and $f_{max}$ the maximum frequency in the frequency range (corresponding to the lowest m/z ratio in the m/z range).

For laser-based or electron-based fragmentation methods which can be used with this implementation like IRMPD (S. A. Hofstadler, K. A. Sannes-Lowery, R. H. Griffey. Infrared Multiphoton Dissociation in an External Ion Reservoir. *Anal. Chem.* 1999, 71, 2067), UVPD (R. Cannon Joe, B. Cammarata Michael, A. Robotham Scott, C. Cotham Victoria, B. Shaw Jared, T. Fellers Ryan, P. Early Bryan, M. Thomas Paul, L. Kelleher Neil, S. Brodbelt Jennifer. Ultraviolet photodissociation for characterization of whole proteins on a chromatographic time scale. *Anal Chem* 2014, 86, 2185), or ETD (G. C. McAlister, D. Phanstiel, D. M. Good, W. T. Berggren, J. J. Coon. Implementation of Electron-Transfer Dissociation on a Hybrid Linear Ion Trap-Orbitrap Mass Spectrometer. *Anal. Chem.* (Washington, D.C., U. S.) 2007, 79, 3525), the zone of high fragmentation efficiency is at the centre of the quadrupole. When the radius of the ion cloud is large (high resonant excitation), the overlap between the ion cloud and the fragmentation zone is small, and little fragmentation can be expected. When the radius of the ion cloud is small (low resonant excitation), the overlap between the ion cloud and the fragmentation zone is high, and the fragmentation efficiency is expected to be high.

Unlike FT-ICR MS, ion manipulation in the LIT does not require ion cloud coherence (M. B. Comisarow, A. G. Marshall. Fourier transform ion cyclotron resonance spectroscopy. *Chem. Phys. Lett.* 1974, 25, 282). As a result, collisionally-activated dissociation can be used in 2D LIT MS without causing a loss of resolution. Fragmentation efficiency in CAD increases with ion kinetic energy: the overlap between ion cloud and the fragmentation zone is therefore high when the ions are excited at high radius, and low when ions are at low radius.

Following these hypotheses, fragment ion abundances in SWIM are modulated at the same encoding frequency (defined in eq. 6) as the radii of their precursors, whether the fragmentation method is laser-based, electron-based, or CAD. This effect makes 2D MS in an LIT possible.

FIG. 3 shows the encoding of the ion cloud radius using SWIM, which consists in the inverse Fourier transform of a broadband excitation. If the excitation waveform has a zero phase at all frequencies, the inverse Fourier transform yields a chirp pulse resulting in a short excitation at high amplitude (A. G. Marshall, T. C. L. Wang, T. L. Ricca. Tailored excitation for Fourier transform ion cyclotron mass spectrometry. *J. Am. Chem. Soc.* 1985, 107, 7893). Chirp pulses impose high voltage amplitude (several 100 $V_{pp}$) and high frequency specifications on the RF amplifiers driving the mass analyser. In order to spread out the contribution of individual frequencies in excitation pulses over time and thus reduce the performance demanded of RF amplifiers, Guan et al. (1990, cited above) proposed an algorithm to optimise the phase modulation of a SWIFT excitation pulse for optimal amplitude reduction. For broadband excitation, the optimal phase modulation is given by eq. 3. For broadband excitation with different amplitude envelopes, the optimal phase modulation depends on the shape of the envelope. For SWIM, this means that the optimal phase modulation function is different for each index n.

Figure 4:
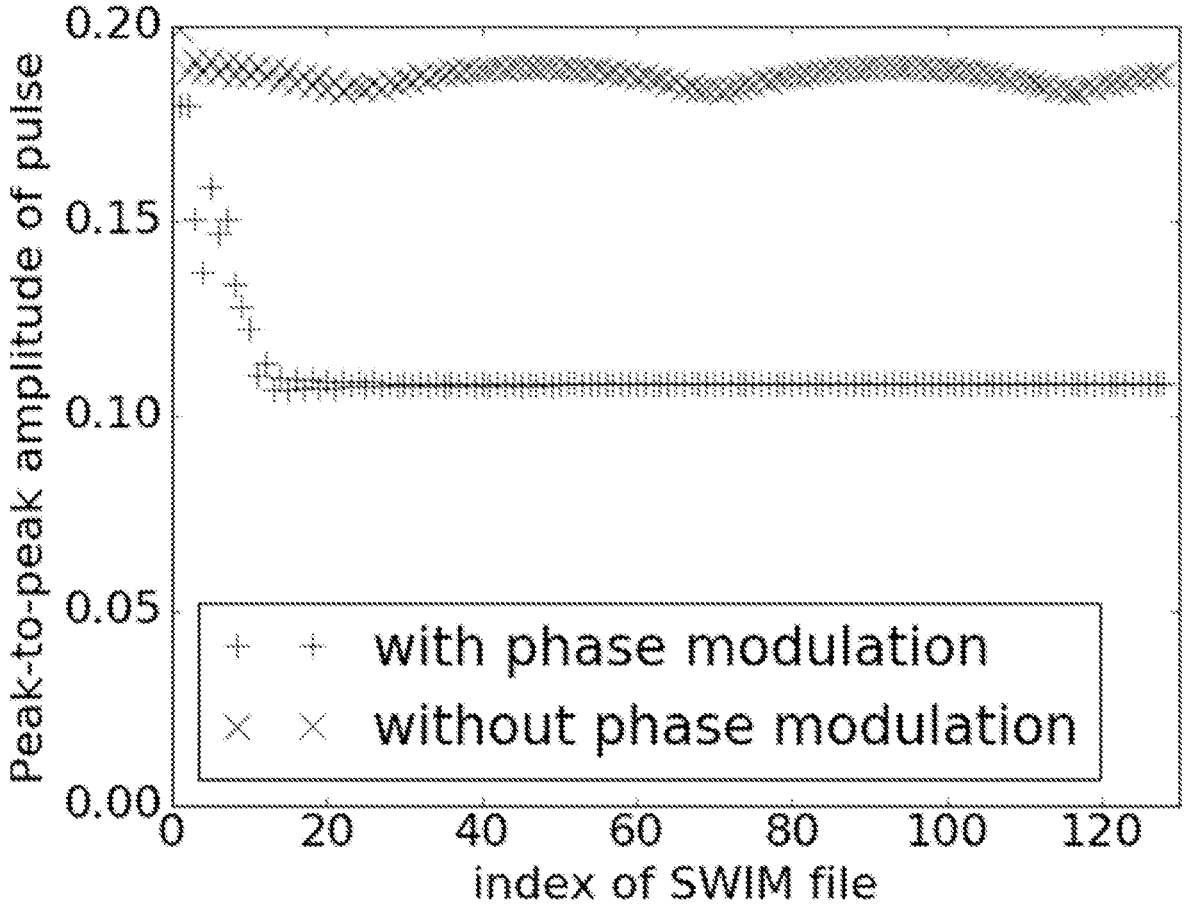
FIG. 4 shows the peak amplitude for each pulse applied to the electrodes of the instrument of FIG. 1.

In an in silico experiment, there is no limitation in voltage amplitudes, but in order to adapt the 2D MS experiment to a physical implementation, two competing factors are in play: the voltage amplitude of the pulse and the length of the pulse. On the one hand, the voltage amplitude of the pulse needs to be within the specifications of the RF amplifiers. On the other hand, compatibility of 2D MS on an LC timescale requires a limited pulse length (in the present experiment, the lowest frequency is 20 kHz, which corresponds to a pulse length of 400 μs). Furthermore, the choice of a phase modulation function that is independent of the SWIM index n leads to quicker generation of SWIM pulses before each experiment. In the present study, the phase modulation function proposed in eq. 3 was chosen. FIG. 4 shows the peak-to-peak amplitude of each pulse with and without phase modulation for normalized frequency-domain envelopes. For all SWIM index, the pulse with phase modulation has a lower amplitude than the pulse without phase modulation. The average amplitude is 0.187 without phase modulation, and 0.111 with phase modulation, which corresponds to an average amplitude reduction of a factor of 1.68. This nearly halves the required specifications of an RF amplifier for a 2D MS prototype.

Figure 5:
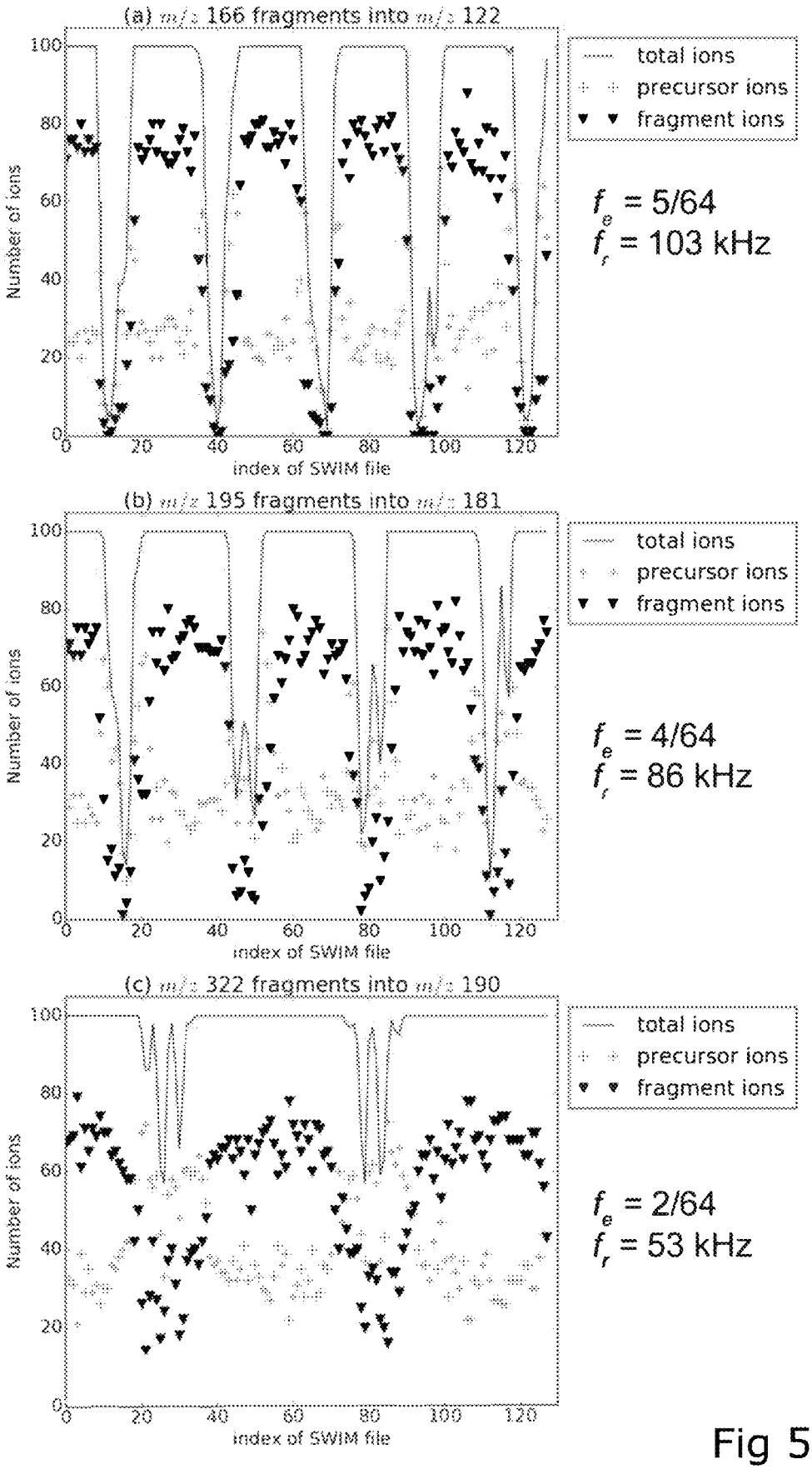
FIG. 5 shows ion count at the end of various simulations carried out with the apparatus of FIG. 1.

FIG. 5 shows the ion count at the end of each ion trajectory calculation as a function of SWIM index n: the total number of ions, the number of precursor ions and the number of fragment ions. The ion trajectory calculations were performed for three m/z ratios: m/z 166, m/z 195, and m/z 322.

FIG. 5 shows that the total number of ions at the end of the simulation is modulated periodically with the index of the SWIM file. The periodic drop in total ion count corresponds to ions getting excited to high radii by the SWIM pulse until they are ejected from the LIT. The decreases in total ion count coincide with decreases of the number of fragment ions: as precursor ion radii increase, their fragmentation efficiency decreases, since the fragmentation zone is located at the centre of the Ln. The behaviour of the number of precursor ions is more complex: as the radius of precursor ions after excitation increases, their fragmentation efficiency decreases, since the precursor ions spend less time within the fragmentation zone. When the precursor ion radius reaches the size of the LIT, the number of precursor ions decreases again, because they are ejected from the LIT before the fragmentation period. This behaviour is not dependent on m/z ratio, as it is repeated for FIGS. 3*a*, 3*b*, and 3*c*. However, the drop in total ion count at high radius increases with decreasing m/z ratio, which may be caused by the truncation at 380 μs of the SWIM pulse, resulting to decreased excitation at lower frequencies, and therefore less excitation at higher m/z ratios.

The frequency of the modulation decreases with m/z ratio: FIG. 5*a* shows that ion counts for precursors of m/z 166 go through 5 cycles, in FIG. 5*b* precursors of m/z 195 go through 4 cycles, and in FIG. 5*c* precursors of m/z 322 go through 2 cycles. These frequencies correspond to the encoding frequencies in eq. 6. The corresponding resonant frequencies are 103 kHz for m/z 166, 86 kHz for m/z 195 and 53 kHz for m/z 322. In all experiments the frequency of the ion count is the same for the precursor ions and the fragment ions, therefore establishing the correlation between precursor ion abundances and fragment ion abundances, and the possibility of 2D mass spectrometry in an Ln.

Figure 6:
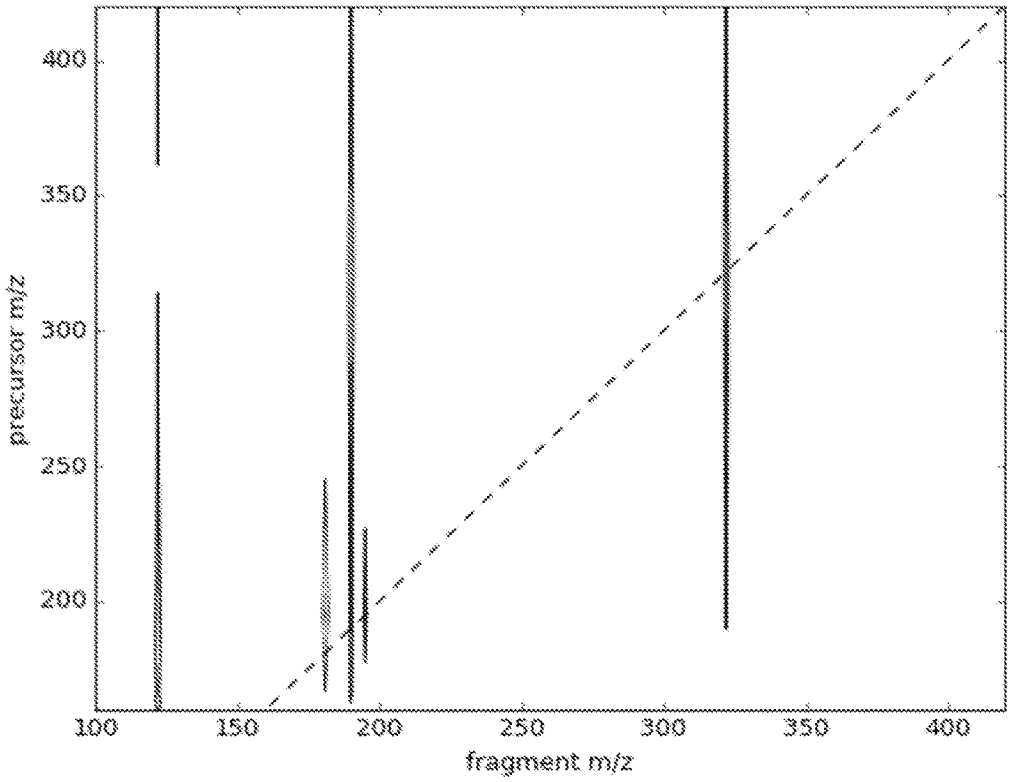
FIG. 6 shows a simulated two-dimensional mass spectrum as obtained from the instrument of FIG. 1.

FIG. 6 shows the 2D mass spectrum generated with the data presented in FIG. 5. As in 2D FT-ICR mass spectra, the horizontal axis represents the m/z ratios measured at the end of the ion trajectory calculations (i.e. fragment m/z ratio), and the vertical axis represents the m/z ratios calculated from the frequency-to-mass conversion (i.e. precursor m/z ratio). The dotted line in FIG. 6 shows the autocorrelation with a $(m/z)_{precursor}=(m/z)_{fragment}$ equation, corresponding to the modulation of precursor ion abundances according to their own encoding frequency (i.e. m/z ratio).

FIG. 6 shows two peaks on the autocorrelation line at m/z (195, 195) and m/z (322, 322). Each precursor ion has a peak on its fragment ion line: m/z (181, 195) for m/z 195 and m/z (190, 322) for m/z 322. The 2D mass spectrum shows a peak at m/z (122, 166), but no corresponding peak on the autocorrelation line at m/z (166, 166): the modulation of the precursor ion is double the frequency of the modulation of the fragment ion, because the excitation is intense enough to cause ion loss both at maximum excitation (by ejection) and at minimum excitation (by fragmentation).

The resolving power in the vertical precursor dimension of the 2D mass spectrum in FIG. 6 is low: less than 10 at m/z 200. Increasing the number of data points along the SWIM index n is likely to increase the resolving power in the precursor dimension considerably, since the 2D MS method is FT-based in the precursor dimension. At present, there is no indication as to what may limit the vertical resolving power beyond the number of data points and frequency instability in the radial direction of the LIT. Similarly, the signal-to-noise ratio in the precursor dimension of the 2D mass spectrum can be expected to increase with the number of data points along the SWIM index n because the 2D MS method is FT-based in the precursor dimension.

In this implementation, unlike in 2D FT-ICR MS studies, calculating the Fourier transform of the data was only necessary in the vertical dimension, because the m/z ratios of ions was measured directly by the SIMION software. In a physical implementation, data processing will depend on the nature of the mass analyser 10. Orbitraps and FT-ICR mass spectrometers are both FT-based, which makes Fourier transforms necessary in both dimensions, but time-of-flights and quadrupoles both rely on computationally faster time-of-flight to m/z ratio conversion.

In this implementation, the LIT has been used as an ion manipulation device. An LIT can be used as a mass analyser as well, or it can be coupled with other mass analysers by transferring ions to the mass analyser at the end of the fragmentation period. Optimizing the ion transfer depends on which mass analyser is used. In terms of cost, the LIT on its own or within a triple quadrupole is the most attractive option, but is slow in terms of acquisition time and has a low resolving power. Coupling the LIT with an Orbitrap or an FT-ICR mass spectrometer increases the resolving power dramatically, but also the cost of the instrument. These two mass analysers also have a slow duty cycle, which translates into long acquisition times. In order to achieve fast acquisition, TOF analysers have a considerable advantage because of their short duty cycles, and may enable to couple 2D MS with online liquid chromatography.

This implementation shows the feasibility of two-dimensional mass spectrometry in a linear ion trap by, in this instance, applying SWIM pulses to modulate the radii of precursor ion clouds before applying a radius-dependent fragmentation method. The resulting fragment ion abundance is modulated with the same encoding frequency as the precursor ion abundance, or half the encoding frequency of the precursor ion abundance if the maximum excitation of the precursors leads to ion ejection. Calculating the Fourier transform of ion abundances and plotting them for each m/z ratio leads to 2D mass spectra that are similar to the ones described for 2D FT-ICR MS.

2D MS in a linear ion trap can therefore be applied to various radius-dependent fragmentation techniques: laser-based (IRMPD, UVPD), electron-based (ETD, PTD), or collision-based (CAD). The LIT can be used both as an ion manipulation device and as a mass analyser, but can be coupled with other mass analysers like an FT-ICR mass spectrometer, an Orbitrap, or a TOF in order to get various desired characteristics in the experimental setup, such as high resolution or fast acquisition times. In particular, coupling the LIT with a mass analyser with a fast duty cycle can lead to acquisition times shorter than 10 s, which makes 2D MS compatible with LC or GC timescales. Such an instrument would lead to LC-2D MS experiments in which the need for ion isolation analysis is eliminated. LC-2D MS would be a very useful technique for the analysis of complex samples, like in proteomics and in petroleomics, in which MS/MS eliminates many analytes.

Figure 7:
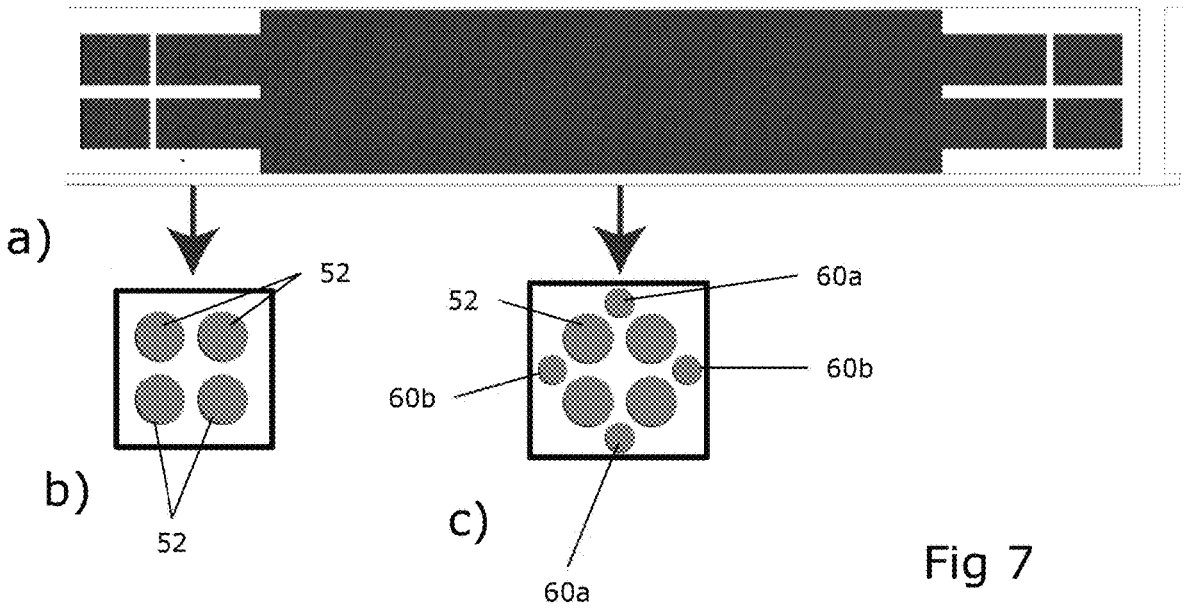
FIGS. 7*a* to 7*c* show cross sections through a mass spectrometry instrument in accordance with a second implementation of the disclosure.
Figure 8:
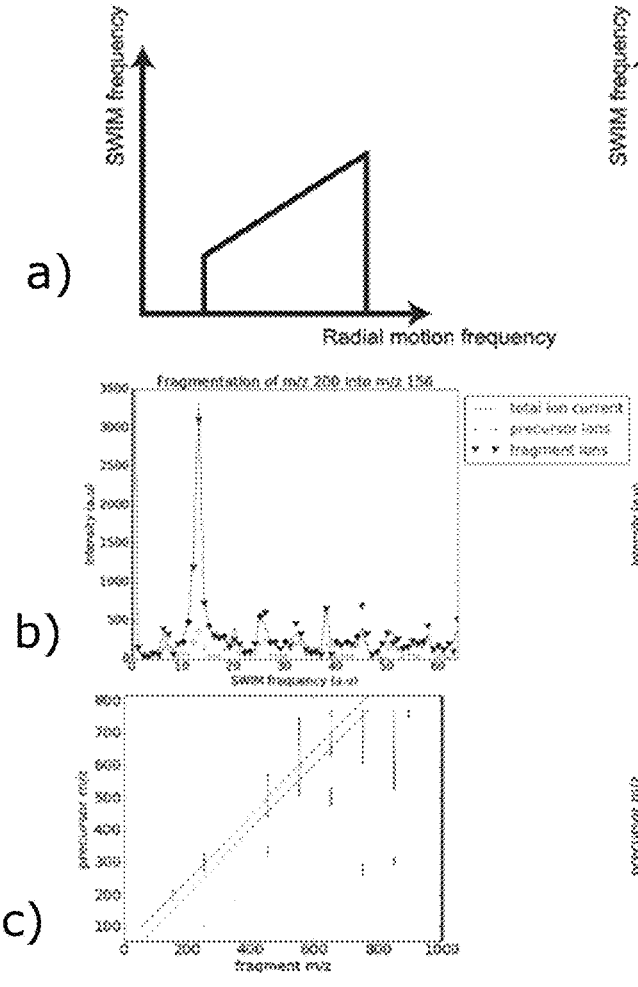
FIGS. 8*a* to 8*c* illustrate a graphical representation of increasing and decreasing frequency profiles.
Figure 9:
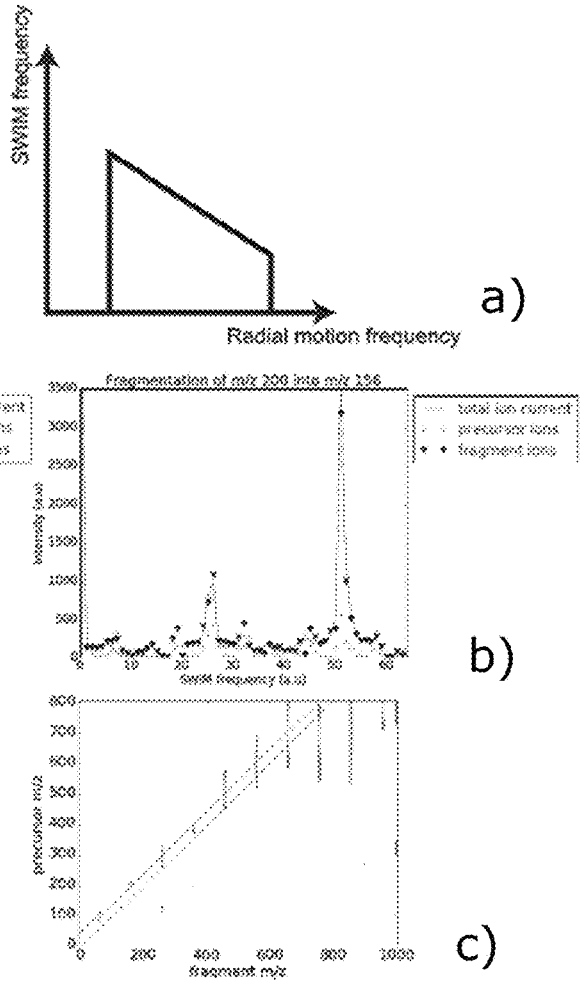
FIGS. 9*a* to 9*c* illustrate a graphical representation of increasing and decreasing frequency profiles.

In a second implementation of the disclosure, shown in FIG. 7 of the accompanying drawings, another mass spectrometry instrument which demonstrates the feasibility of 2D mass spectrometry in a linear ion trap is shown. Equivalent integers to those of the first implementation are identified with corresponding reference numerals, raised by 50.

In this implementation, a set of four quadrupole electrodes 52 is provided along the length of the instrument to provide the fields to hold the ions captive. A further set of four excitation electrodes 60*a*, 60*b*, is provided as two pairs of electrodes, each pair 60*a*, 60*b* comprising two electrodes on opposite sides of the quadrupole electrodes 52.

As such, rather than applying the SWIM excitation pulses to the quadrupole electrodes 52, they are instead applied to the excitation electrodes. Furthermore, rather than applying the excitation pulses to just one pair 60*a*, 60*b* of excitation electrodes, after the SWIM inverse Fourier transform step is taken, the real part of the time domain pulse can be applied to one pair 60*a* whereas the imaginary part is applied to the other pair 60*b*.

This gives similar results to simply applying the pulse to one pair of electrodes, but with (at least approximately) half the amplitude applied to each pair of electrodes. As such, the peak amplitudes can be reduced.

Furthermore, in this implementation, rather than having a SWIM frequency that increases linearly with the radial motion frequency, the SWIM frequency decreases with radial motion frequency. Ion abundances are modulated at $f_{Nyquist}-f$ instead off.

The full-width at half-maximum is independent of frequency, which results in mass accuracy and mass resolution that decreases with m/z ratio regardless of the frequency profile. This can be seen in FIGS. 8*a*-8*c* and 9*a*-9*c* of the accompanying drawings, which show the results with increasing and decreasing frequency profiles. In each of these Figures, graph a) shows the SWIM frequency for a given radial motion frequency, graph b) shows the MS intensity at a given frequency and graph c) shows the resultant 2D mass spectrum.

The invention claimed is:

1. A method of carrying out mass spectrometry, comprising:

using an electrostatic or electrodynamic ion trap to contain a plurality of ions, each ion having a mass to charge ratio, the plurality of ions having a first plurality of mass to charge ratios and a second plurality of mass to charge ratios, wherein each ion of the first plurality of mass to charge ratios follows a path within the electrostatic or electrodynamic ion trap having a radius; and wherein each of the second plurality of mass to charge ratios are discretely spaced apart within a continuous range and for each of the second plurality of mass to charge ratios the method comprises:

modulating radii of the ions in a mass to charge ratio-dependent fashion dependent upon the mass to charge ratio;

fragmenting the ions thus modulated in a radius-dependent fashion within the ion trap; and determining a mass spectrum of the ions after each fragmentation.

2. The method of claim 1, in which the electrostatic or electrodynamic ion trap comprises one of: a linear ion trap (LIT), a quadrupolar ion trap, a three-dimensional ion trap, or an ion trap whose ions have consistent oscillation frequencies.

3. The method of claim 1, in which the modulation of the radii comprises modulating an electric field applied to the ions.

4. The method of claim 3, comprising applying excitation pulses, separated by a delay, with the delay providing the mass to charge ratio dependence.

5. The method of claim 3, comprising applying a modulated excitation pulse, which is modulated at a frequency.

6. The method of claim 5, in which the frequency is such so as to provide a resonance with an oscillation frequency of ions having the second plurality of mass to charge ratio.

7. The method of claim 5, in which the modulated excitation pulse comprises at least one of a Stored Waveform Inverse Fourier Transform (SWIFT) and a Stored Waveform Ion Radius Modulation (SWIM) pulse.

8. The method of claim 1, in which the modulation of the radii comprises preferentially changing the radii of the ions having the mass to charge ratio to a path with a different radius, or changing the radii of the ions not having the mass to charge ratio to a path with a different radius.

9. The method of claim 1, in which the step of fragmenting the ions comprises fragmenting ions which pass through a fragmentation zone.

10. The method of claim 9, in which the modulation of the radii modulates radii of ions into and/or out of the fragmentation zone.

11. The method of claim 1, in which the mass spectra are determined using at least one of the following group of instruments:

a time of flight (TOF) mass spectrometer;

a Fourier Transform Ion Cyclotron Resonance (FT ICR);

a Linear Ion Trap (LIT); and an Orbitrap mass spectrometer.

12. The method of claim 1, in which the mass spectra are determined using a triple quadrupole (QQQ) mass spectrometer.

13. The method of claim 1, wherein the step of modulating the radii of the ions in a mass to charge ratio-dependent fashion serves to place only ions with a particular mass to charge ratio within a fragmentation zone at a given time, and wherein the modulation of the path radii of the ions is varied with time to move ions with different mass to charge ratios into or out of the fragmentation zone.

14. The method of claim 1, wherein each of the second plurality of mass to charge ratios are separately modulated, fragmented, and determined.

15. A mass spectrometry instrument, comprising an electrostatic or electrodynamic ion trap and a control circuit for the electrostatic or electrodynamic ion trap, the electrostatic or electrodynamic ion trap comprising electrodes comprising at least two axial trapping electrodes, a plurality of radial trapping electrodes and at least one excitation electrode, in which the control circuit is arranged so as to:

apply voltages to each excitation electrode so as to contain, in use, a plurality of ions within a void defined by the electrodes, each ion following a path within the electrostatic or electrodynamic ion trap having a radius, the ions having a first plurality of mass to charge ratios; and a second plurality of mass to charge ratios, and wherein for each of a second plurality of the mass to charge ratios are discretely spaced apart within a continuous range and for each of the second plurality of mass to charge ratios the mass spectrometry instrument is configured to:

modulate the radii of the ions dependent upon the mass to charge ratio; and wherein the instrument further comprises a fragmentation device arranged to fragment the ions of the second plurality of mass to charge ratios that were modulated in a radius-dependent fashion, wherein the ions are fragmented within the ion trap; and a mass determination device arranged to determine a mass spectrum of the ions after each fragmentation.

16. The instrument of claim 15, in which the electrostatic or electrodynamic ion trap comprises one of: a linear ion trap (LIT), a quadrupolar ion trap, a three-dimensional ion trap, or an ion trap whose ions have consistent oscillation frequencies.

17. The instrument of claim 15, in which the control circuit is arranged such that the modulation of the radii comprise modulating an electric field applied to the ions using each excitation electrode.

18. The instrument of claim 15, in which the control circuit is arranged such that the modulation of the radii comprises preferentially changing the radii of the ions having the particular mass to charge ratio to a path with a different radius, or preferentially changing the radii of the ions not having the particular mass to charge ratio to a path with a different radius.

19. The instrument of claim 15, in which the fragmentation device is arranged to fragment ions which pass through a fragmentation zone.

20. The instrument of claim 19, in which the control circuit is arranged to as to modulate the radii so as to shift ions into and out of the fragmentation zone.

21. The instrument of claim 15, in which the mass determination device comprises an instrument selected from the group comprising:

a time of flight (TOF) mass spectrometer;

a Fourier Transform Ion Cyclotron Resonance (FT ICR) mass spectrometer;

a Linear Ion Trap (LIT) mass spectrometer;

an Orbitrap mass spectrometer; and a triple quadrupole (QQQ) mass spectrometer.

* * * * *